US010871355B2

(12) United States Patent
Flater, IV et al.

(10) Patent No.: US 10,871,355 B2
(45) Date of Patent: Dec. 22, 2020

(54) METAL CELLULAR STRUCTURES FOR COMPOSITE STRUCTURES REINFORCEMENT

(71) Applicant: US Govt as represented by Secretary of Air Force, Wright-Patterson AFB, OH (US)

(72) Inventors: Philip J. Flater, IV, Niceville, FL (US); Charles M. Jenkins, Ft Walton Beach, FL (US)

( * ) Notice: Subject to any disclaimer, the term of this patent is extended or adjusted under 35 U.S.C. 154(b) by 0 days.

(21) Appl. No.: 16/819,237

(22) Filed: Mar. 16, 2020

(65) Prior Publication Data

US 2020/0309492 A1 Oct. 1, 2020

Related U.S. Application Data

(60) Provisional application No. 62/827,220, filed on Apr. 1, 2019.

(51) Int. Cl.
*F42B 12/20* (2006.01)

(52) U.S. Cl.
CPC ..... *F42B 12/208* (2013.01)

(58) Field of Classification Search
CPC ..... F42B 12/208
See application file for complete search history.

(56) References Cited

U.S. PATENT DOCUMENTS

2020/0023584 A1* 1/2020 Portela ..... B29C 64/30

OTHER PUBLICATIONS

Al-Ketan, O., Rowshan, R., Al-Rub, R. Topology-mechanical property relationship of 3D printed strut skeletal, and sheet based periodic metallic cellular materials. Additive Manufacturing. 19(2018), pp. 167-183.

Wadley, H.N.G., O'Masta, M.R., Dharmasena, K.P., Compton, B.G., Gamble, E.A. Effect of core topology on projectile penetration in hybrid aluminum/alumina sandwich structures. Int. J. of Impact Engr. 62 (2013), pp. 99-113.

* cited by examiner

*Primary Examiner* — Reginald S Tillman, Jr.
(74) *Attorney, Agent, or Firm* — AFMCLO/JAZ; David E. Franklin

(57) ABSTRACT

A munition includes a triply periodic minimal surface (TPMS) structure attached to an inner surface of a cylindrical tube. The TPMS structure is formed by an additive manufacturing process to promote fluid permeability and to reduce pressure drop to prevent trapped air and maximize surface area contact at a structure and liquid interface. An explosive material is introduced into one or more upper apertures of the TPMS in a flowable state to fill the TPMS structure n a compartmentalized arrangement that provides stiffness to the munition.

4 Claims, 4 Drawing Sheets

METAL CELLULAR STRUCTURES FOR COMPOSITE STRUCTURES REINFORCEMENT

CROSS-REFERENCE TO RELATED APPLICATIONS

This application claims the benefit of priority under 35 U.S.C. § 119(e) to U.S. Provisional Application Ser. No. 62/827,220 entitled "Metal Cellular Structures for Composite Structures Reinforcement", filed 1 Apr. 2019, the contents of which are incorporated herein by reference in their entirety.

ORIGIN OF THE INVENTION

The invention described herein was made by employees of the United States Government and may be manufactured and used by or for the Government of the United States of America for governmental purposes without the payment of any royalties thereon or therefore.

BACKGROUND

1. Technical Field

The present disclosure generally relates to munitions and methods of introducing and supporting explosive material within a munition.

2. Description of the Related Art

Many types of airborne munitions such as missiles and bombs contain an explosive section that contains bulk explosive material within a cylindrical casing. The cylindrical casing traditionally was formed from a metal for strength and resistance to premature rupturing. Such metals are heavy, limiting the active payload that can be contained in munition. Other airborne munitions use a carbon fiber composite casing for reducing munition weight and for allowing other types of blast effects. In order to achieve comparable strength to metal casing, the carbon fiber composite casings have to increase in thickness, which reduces available volume for bulk explosive material.

The bulk explosive material is introduced into the cylindrical casing in a flowable state and allowed to harden. To avoid entrapping air, the interior of the cylindrical casing generally has no structural impediments. Support to the hardened bulk explosive material is thus provided only by the interior surface of the cylindrical casing. Any inadvertent impacts to the munition can cause damaging movement of the explosive material.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
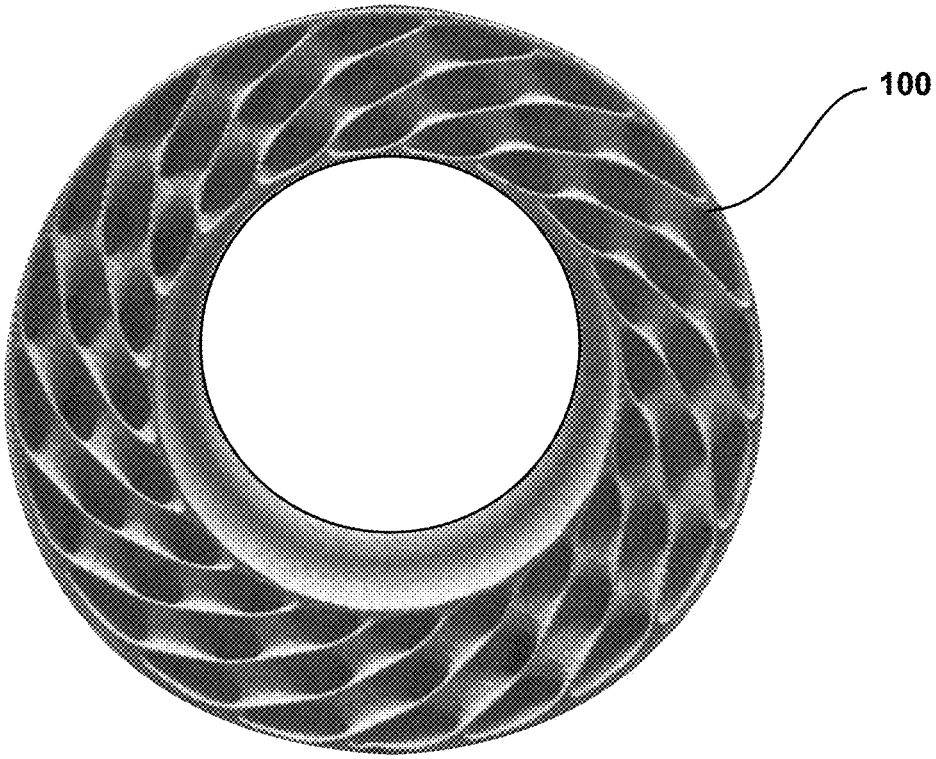
FIG. 1 is an end view illustrating a first example additively-manufactured TPMS structure, according to one or more embodiments.
Figure 2:
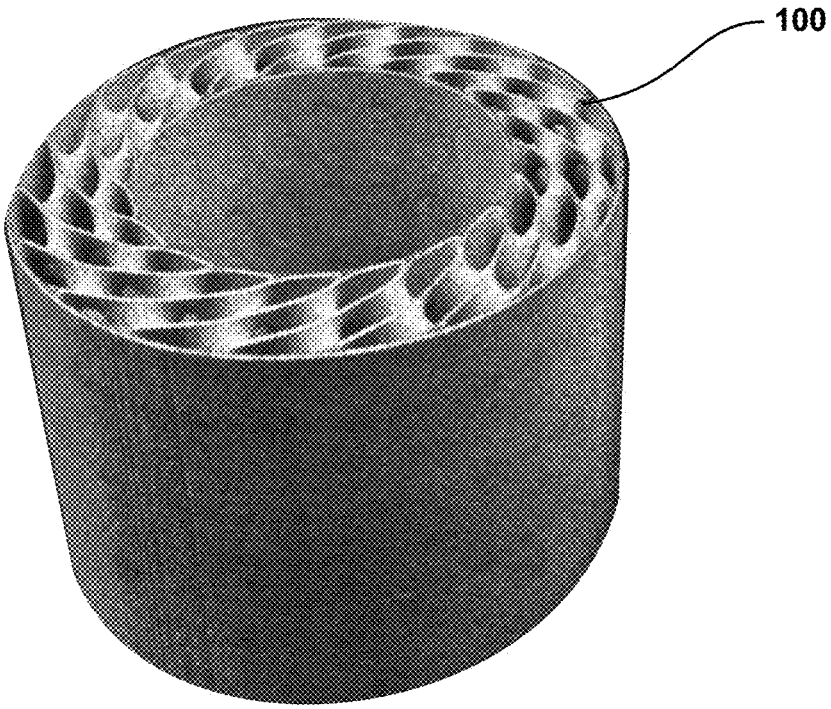
FIG. 2 is an isometric view illustrating the first example additively-manufactured TPMS structure of FIG. 1, according to one or more embodiments.
Figure 3:
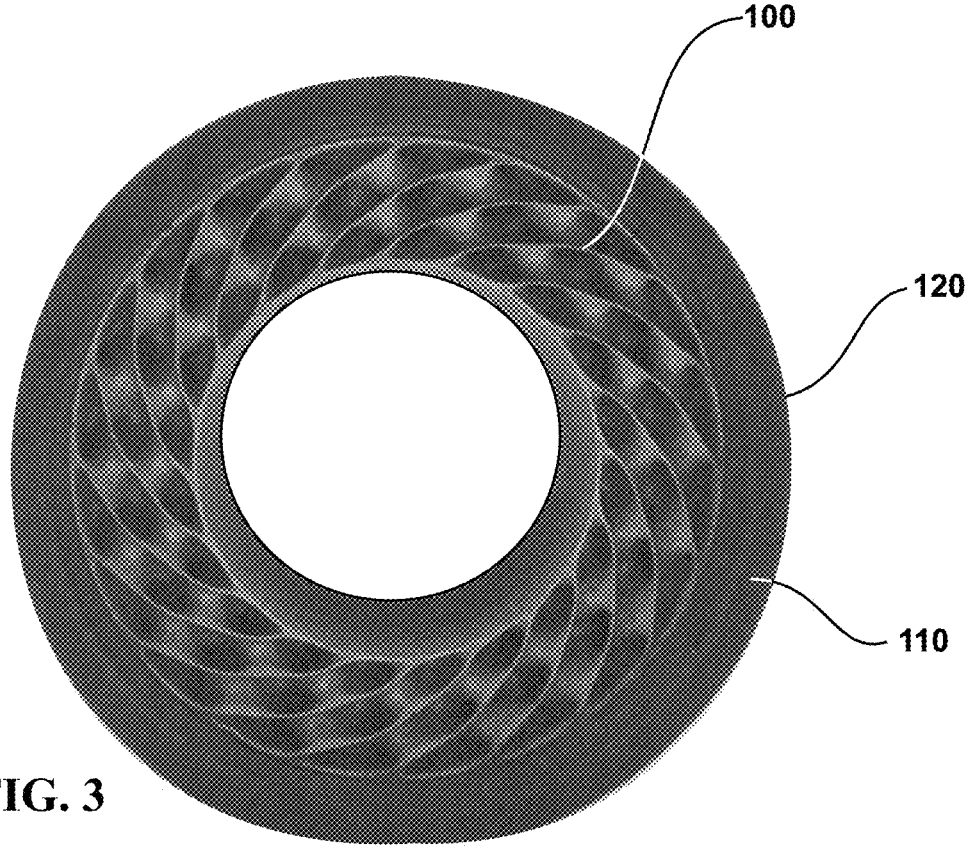
FIG. 3 is an end view of the TPMS structure of FIG. 1 inserted into a wound carbon fiber reinforced polymer (CFRP) tube to form a first munition, according to one or more embodiments.

FIG. 1 is an end view illustrating a first example additively-manufactured TPMS structure 100 with thin inner and outer walls. FIG. 2 is an isometric view illustrating the first example additively-manufactured TPMS structure 100. The TPMS structure 100 provides cavity compartmentalization for spatial isolation of different materials, such as liquids or castable solids. FIG. 3 is an end view of the TPMS structure 100 of FIG. 1 inserted into a wound carbon fiber reinforced polymer (CFRP) tube 110 to form a munition 120.

Figure 4:
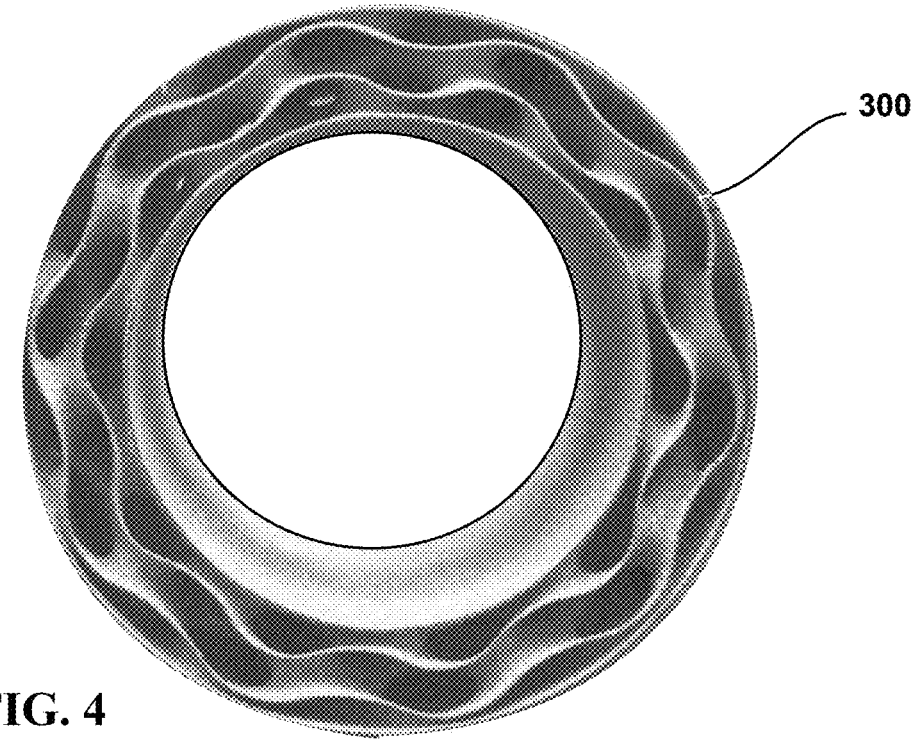
FIG. 4 is an end view illustrating a second example additively-manufactured TPMS structure, according to one or more embodiments.
Figure 5:
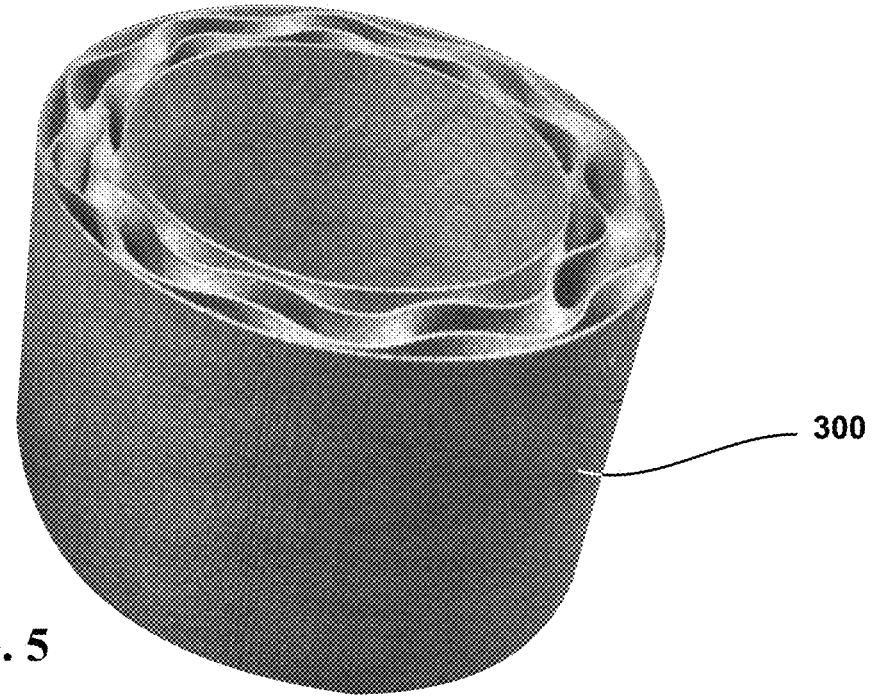
FIG. 5 is an isometric view illustrating the second example additively-manufactured TPMS structure of FIG. 4, according to one or more embodiments.
Figure 6:
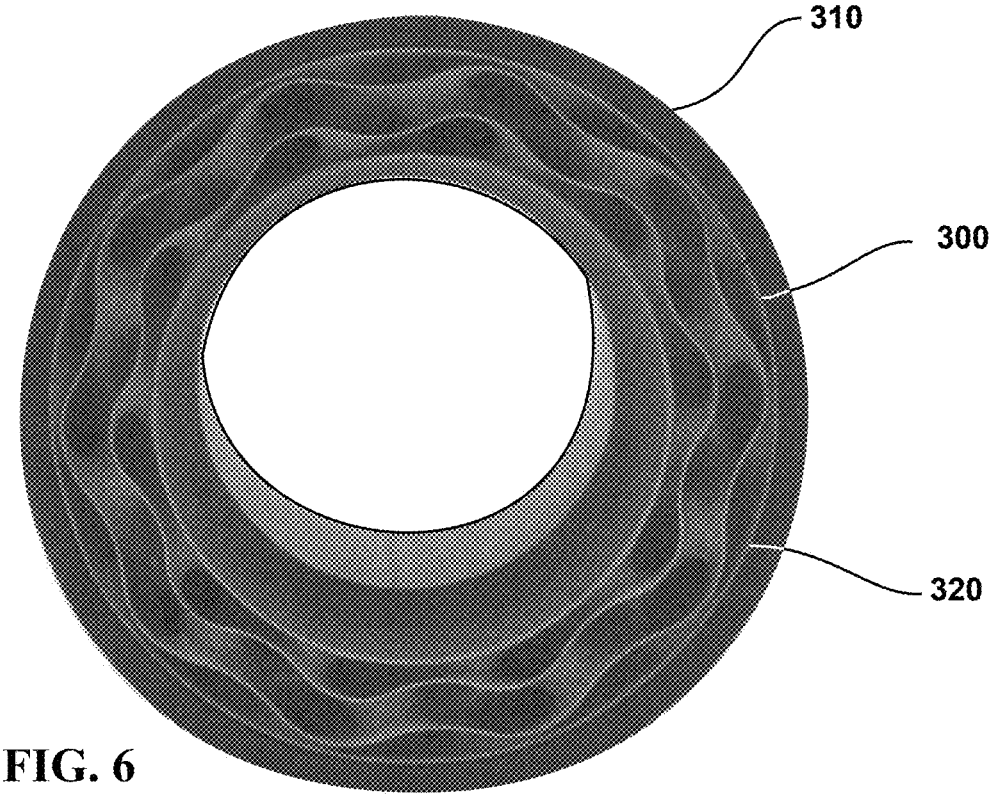
FIG. 6 is an end view of the TPMS structure of FIG. 4 inserted into a wound CFRP tube to form a second munition, according to one or more embodiments.

FIG. 4 is an end view illustrating a second example additively-manufactured TPMS structure 300 with thin inner and outer walls having flowable paths and a structural that is similar to TPMS structure 100 (FIG. 1). FIG. 5 is an isometric view illustrating the second example additively-manufactured TPMS structure 300. The TPMS structure 300 provides cavity compartmentalization for spatial isolation of different materials, such as liquids or castable solids. FIG. 6 is an end view of the TPMS structure 300 of FIG. 3 inserted into a wound CFRP tube 310 to form a munition 320.

Figure 7:
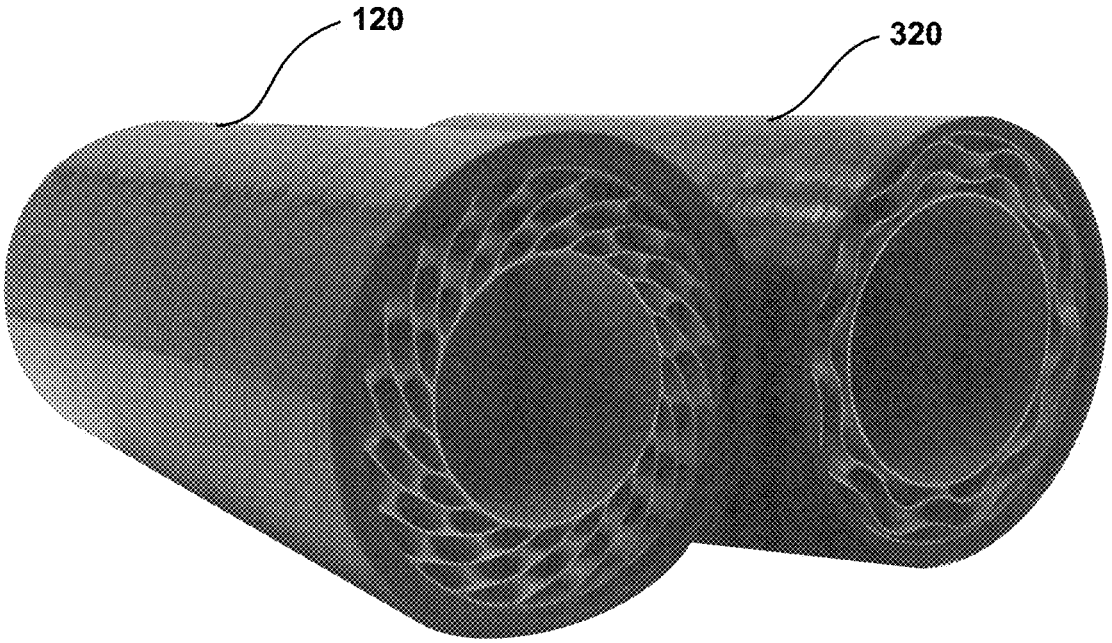
FIG. 7 is an isometric view of munitions of FIGS. 3 and 6.

FIG. 7 is an isometric view of munitions 120, 320 showing inner and exterior thin supportive wall (0.5 mm thickness). These examples were manufactured in stainless steel 17-4PH, but any printable material can be used.

The present innovation utilizes a unique metal lattice design produced in steel, aluminum, plastic or other structural materials via an additive manufacturing technique to support a composite structure (metal cellular/composite hybrid) for increased stiffness-to-weight in compression, torsion, surface area and bending strength. This allows the hybrid structure to reduce structural mass and increase the usable internal volume while maintaining original structural properties of the composite structure or other material casing alone. The unique lattice design also provides an improved ability to permeate the structure with liquids such as polymer, wax, or otherwise to reduce the incidence of trapped air pockets and improve the homogeneity of the liquid fill when it solidifies; in addition to generic applications where a structural heat exchanger can be used to increase counter current heat transport. The lattice structure is also designed to allow chemical treatment to form adhesion of functional groups enabling specific attachment points along the lattice surface making it useful for catalytic unit operations where the catalyst is part of the transport tube, catalyst design w/new shapes for increased inter facial contact between the solid and liquid surface & multi-layered/embedded or staged catalytic sections for multi-step chemical reactions, replacement catalytic or filtration cartridge to reduce unit down times due to cleaning, ease of catalyst replacement for structural damage. Reactor design where high catalytic surface area and low pressure drop is desirable. Better bonding between the lattice and composite structures while simultaneously stiffening the overall system (lattice, composite, and fill). This is significant for utilization in long cylindrical tubes such as pilings, high velocity penetrating structures, and safety items where enclosed material fills are subject to vibration, shock induced forces, or long duration compressive, bending, or torsional forces and for chemical unit operations such as continuous flow reactors (plug flow) and catalytic design.

The idea for this innovation was based on a requirement to develop a technology which improves a composite cylindrical tube's resistance to bending, compression, and torsional forces while reducing its initial weight and increasing internal volume. It was determined that this could be done using a metallic lattice structure similar in concept to a bridge truss that could be made by an additive manufacturing process. The volume increase comes from the fact that the truss system takes up only 2025 percent of the new recovered volume therefore a net gain of usable volume of 75% is achieved by reducing the wall thickness and replacing it with a lattice structure. Additionally, for filling operations with viscous materials, a customizable triply periodic minimal surface (TPMS) structure was developed to promote fluid permeability and reduce pressure drop to prevent trapped air and maximize surface area contact at the metal and liquid interface.

This invention has several significant technological capabilities of benefit to both the United States Air Force (USAF) and the public sector. For the USAF and Department of Defense (DoD), this innovation provides an additively manufactured metallic customizable triply periodic minimal surface (TPMS) structure support system which can be used to provide stiffness and support, material reactivity, and ease of loading high explosive to the inner surface of the bomb body shell. Explosive fills (wax or polymer-based) and particle systems (reactive or inert) can be compartmentalized to make complex structures that enhance blast and/or provide new capability such as selectable effect through control of the explosive detonation process. Furthermore, integration of cellular structure reinforcement in bulk explosives will stiffen the overall structure and secure the filler from movement within the case material, thus reducing sensitivity to auto-initiation.

All parts of this invention are serviceable, replaceable, and can be commercially produced with the proper design criteria, manufacturing technique, and use of or variation on the unique cellular structure design portion of this invention. The invention is a combination of technologies, materials and structures, and fabrication techniques developed to provide increased carbon composite strength, increased internal available empty filling volume, improved ease of filling liquid polymers, waxes or other fluids within the cellular structure. The ability to provide chemically bonded adhesion points on the reinforcement cellular structure for polymer fill materials will resist movement within the encased structure during vibration or shock loading.

According to aspects of the present disclosure, the geometry of the cellular structure insert can be substituted or modified to achieve the desired mass and performance characteristics. For example, a coarser structure can be implemented to ensure infiltration of higher-viscosity fluids. Wall thickness of the cellular structure itself can be increased/decreased to control cavity volume and overall mass and strength. The type of cellular structure can be changed to suit performance requirements. Varying types include other TPMS structures like Schwarz primitive, Schoen gyroid, Schwarz diamond, etc. or more conventional lattice-type architectures.

According to aspects of the present disclosure, for structural engineering applications, the addition of an annular structural filler such as a polymer or concrete material will provide increased compressive strength, increased stiffness, and reduced weight. (1) In chemical engineering unit operations such as reactor design (Plug Flow/Continuous flow), this invention will benefit reactors where catalysts are integral part of the transport tube, provide catalyst design with/new shapes for increased contact surface & multi-layered/embedded or staged catalytic sections for multi-step chemical reactions, replacement catalytic or filtration cartridges to reduce unit down times due to cleaning, repair or replacement, ease of catalyst replacement when different material reactions are required (i.e. repurposing the reactor for a different chemical material process). (2) Reactor design where high catalytic surface area and low pressure drop is desirable. (3) Modularized operations where reactor unit strength or replacement time is a factor that influences the need for size and weight reduction. (4) Single use expendable items where size, strength and increased volume is a critical design requirement for performance (5) Consumer products such as bicycles (Frames), automobiles, and other commercial transport vehicles. (6) Generic cross-flow heat exchangers where structural stiffness and heat transfer may be optimized.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

In the preceding detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A munition comprising:

a cylindrical tube;

a triply periodic minimal surface (TPMS) structure attached to an inner surface of the cylindrical tube and formed by an additive manufacturing process to promote fluid permeability and to reduce pressure drop to prevent trapped air and maximize surface area contact at a structure and liquid interface; and an explosive material that is introduced into one or more upper apertures of the TPMS in a flowable state to fill the TPMS structure in a compartmentalized arrangement that provides stiffness to the munition.

2. The munition of claim 1, wherein the TPMS structure has more than one flow path between respective upper and lower apertures, at least one flow path filled with a first material and at least one other flow path filled with a second material that combine to produce the explosive material.

3. The munition of claim 1, wherein the TPMS structure comprises a selected one of: (i) Schwarz primitive; (ii) a Schoen gyroid; and (iii) a Schwarz diamond.

4. The munition of claim 1, wherein the cylindrical tube comprises a carbon fiber composite that receives structural support to resist compression, twisting and bending from the TPMS structure.

* * * * *